US006846104B2

(12) United States Patent
Geyer

(10) Patent No.: US 6,846,104 B2
(45) Date of Patent: Jan. 25, 2005

(54) TOURBILLION

(75) Inventor: Helmut Geyer, Glashuette (DE)

(73) Assignee: Lange Uhren GmbH, Glashuette (DE)

( * ) Notice: Subject to any disclaimer, the term of this patent is extended or adjusted under 35 U.S.C. 154(b) by 0 days.

(21) Appl. No.: 10/467,422

(22) PCT Filed: Nov. 22, 2002

(86) PCT No.: PCT/EP02/13107

§ 371 (c)(1),
(2), (4) Date: Aug. 7, 2003

(87) PCT Pub. No.: WO03/048871

PCT Pub. Date: Jun. 12, 2003

(65) Prior Publication Data

US 2004/0062149 A1 Apr. 1, 2004

(30) Foreign Application Priority Data

Dec. 7, 2001 (DE) ..... 101 60 287

(51) Int. Cl.[7] ..... G04B 15/00; G04B 25/02; G04B 27/02

(52) U.S. Cl. ..... 368/127; 368/146; 368/190

(58) Field of Search ..... 368/124, 127–131, 368/140, 142, 145–146, 185, 190

(56) References Cited

U.S. PATENT DOCUMENTS

| | | | | |
|---|---|---|---|---|
| 5,608,694 A | * | 3/1997 | Grimm et al. | 368/127 |
| 6,196,713 B1 | | 3/2001 | Meis et al. | |
| 6,295,249 B1 | * | 9/2001 | Takahashi et al. | 368/35 |
| 6,402,368 B1 | * | 6/2002 | Grimm et al. | 368/127 |
| 6,406,176 B1 | * | 6/2002 | Takahashi et al. | 368/101 |
| 6,428,201 B1 | * | 8/2002 | Shibuya et al. | 368/106 |

FOREIGN PATENT DOCUMENTS

| | | |
|---|---|---|
| EP | 0 727 721 A1 | 8/1996 |
| FR | 687649 | 8/1930 |

OTHER PUBLICATIONS

Das Tourbillon: Faszination der Drehung laute Bewunderung und viele leise Fragen, Uhren Komplikationen UJS DEc. 1992.

* cited by examiner

*Primary Examiner*—Vit W. Miska
(74) *Attorney, Agent, or Firm*—Cohen, Pontani, Lieberman, & Pavane

(57) ABSTRACT

A tourbillon for a watch having a setting device for setting the hands of the watch includes a circular balance wheel that can swivel about a swivel axis. In addition, an escapement is provided that consists of a pallet and an escape wheel, the balance wheel and the escapement arranged on a base plate. A balance wheel shaft of the balance is rotationally mounted with its one end on the base plate and with its other end on a cage that surrounds the balance wheel like a basket. The cage comprises, outside of the radially encircling periphery of the balance wheel, a number of interspaced pillars fastened to the base plate and forms, with the base plate, a rotating mount which can be rotationally driven about rotation axis that is coaxial to the swivel axis by a seconds drive of the watch. A stop device can be actuated by the setting device and swiveling movement of the balance wheel can be blocked by the stop device. The stop device has an approximately V-shaped double-arm spring, which can be moved out of a normal position while being radially displaced outside of the encircling movement path of the pillars and into a blocking position in which it can rest in a flexible manner against the radially encircling contour of the balance wheel via contact areas and on both end areas of both of its spring arms that are oriented in and counter to the encircling direction of the contour of the balance wheel.

17 Claims, 7 Drawing Sheets

5
28
3
37
6
7
11
14
1
12
4
26
27
10
12
3
23
21
3
39
29
36
38
35
34
25
24
33
31
30
19
20
17
16
18

28
32
37
9
2
11
8
4
6
15
12
12
10
14
27
7
2
34
17
31
19
25
33
30
16
18

TOURBILLION

This is a U.S. national stage of application No. PCT/EP02/13107, filed on 22 Nov. 2002. Priority is claimed on that application and on the following application(s): Country: Germany, Application No.: 101 60 287.1, Filed: 07 Dec. 2001.

BACKGROUND OF THE INVENTION

1. Field of the Invention

The invention relates to a tourbillon for a timepiece, having a setting device for setting the hands of the timepiece, having a circular balance wheel, which can be pivoted about a pivot pin, and with an escapement comprising a pallet and escapement wheel. The balance wheel and the escapement are arranged on a base plate and a balance staff of the balance wheel is mounted in a rotatable manner, by way of one end, on the base plate and, by way of its other end, on a cage which encloses the balance wheel in a basket-like manner and which has, outside the radially circulating periphery of the balance wheel, a plurality of pillars spaced apart from one another on the base plate and forms, together with the base plate, a rotary mount which is fixed to the seconds drive of the timepiece and can be driven in a rotatable manner, by means of said drive, about a swivel pin which is coaxial with the pivot pin.

2. Description of the Prior Art

Tourbillons of the type mentioned in the introduction are known.

It is also known, in the case of timepieces without a tourbillon, that, for setting the minute hand, the balance wheel is arrested by a spring arm, which is pivoted for abutment against the balance wheel, and, following completion of the operation of setting the hands, the act of pivoting the spring arm away from the balance wheel releases the latter again from its arrested state.

It is not possible to use such an arresting action of the balance wheel in timepieces with a tourbillon, since this results in the stationary spring arm colliding with the circulating cage of the tourbillon.

SUMMARY OF THE INVENTION

The object of the invention is thus to provide a tourbillon of the type mentioned in the introduction which easily allows the pivoting movement of the balance wheel to be blocked when a setting device of the timepiece is actuated.

This object is achieved according to the invention by a stop device that can be actuated by the setting device to block the pivoting movement of the balance wheel. The stop device has an approximately V-shaped or U-shaped double-arm spring which can be moved out of a normal position, radially outside the circulating movement path of pillars of the cage of the tourbillon, into a blocking position, in which it can be positioned resiliently against the radially circulating contour of the balance wheel by way of abutment regions at the free end regions of its two spring arms, which are directed in and counter to the circulating direction of the contour of the balance wheel.

This design, on the one hand, ensures that the stop device is located outside the circulating movement path of the pillars in the normal position and thus does not collide with the circulating cage.

At the same time, the double-arm spring ensures that, when one spring arm bears against a pillar of the cage, the other spring arm can continue to arrest the balance wheel directly.

In order both for it to be possible to keep the span of the double-arm spring small and to avoid the two abutment regions bearing simultaneously against a pillar, it is possible for those end regions of the spring arms which act on the balance wheel to be spaced apart from one another, in the radially encircling direction in respect of the balance wheel, by a distance which is smaller than the smallest distance between the pillars.

If the point of connection between the two spring arms, with the double-arm spring located in the blocking position, is outside the circulating movement path of the pillars, then it is possible, in the blocking position, for the two spring arms to engage around a pillar and to butt against the balance wheel on both sides of the pillar.

If the free ends of the spring arms extend away from the balance wheel in an approximately ramp-like manner from their abutment regions against the balance wheel, then the situation where these free ends make their way in-between the balance wheel and pillars is avoided.

It is preferable here for the free end of the rear spring arm, as seen in the direction of rotation of the rotary mount, to extend, in the blocking position of the double-arm spring, to a point radially outside the circulating movement path of the pillars, with the result that, even when the free end of this spring arm is located right up against a pillar in the blocking position, this end of the spring arm is prevented from making its way in-between the balance wheel and pillar when the timepiece is restarted. The situation where the free ends of the spring arms catch on the balance wheel, furthermore, is avoided in that the distances between the point of connection and the abutment regions of the two spring arms are different.

It is preferable here for the distance between the point of connection and abutment region of the front spring arm, as seen in the direction of rotation of the rotary mount, to be larger than the distance between the point of connection and abutment region of the rear spring arm, as seen in the direction of rotation of the rotary mount.

In order that the double-arm spring can always be adapted, by way of the abutment regions of its spring arms, to the locations against which the abutment regions of the spring arms come to bear, the double-arm spring, in the region of its point of connection, is preferably articulated on a pivot lever such that it can be pivoted freely about an articulation pin which is parallel to the swivel pin of the rotary mount, it being possible for the pivot lever to be actuated in a pivotable manner about a pin likewise parallel to the swivel pin, the double-arm spring moving between its normal position and its blocking position.

Since, in the case of the various possible positions of the double-arm spring in relation to the balance wheel and to the pillars of the cage, the articulation pin is spaced apart from the pivot pin of the balance wheel to different extents, it is possible, in order to achieve always the same pivoting angle of the pivot lever, for the latter to be an abutment lever which, in its region between the pin and the articulation pin, is resilient approximately in the radial direction in relation to the balance wheel.

In order to pivot the pivot lever, the pivot lever is preferably a two-armed lever, of which one arm is an abutment lever, which extends between the pin and the articulation pin, and the other arm is an actuating arm, which extends away from the pin and can be subjected to pivoting action.

If the actuating arm here is of resilient design in the pivoting direction of the pivot lever from the normal position into the blocking position, then this results in a further increase in the possibilities for compensating for the difference spacings of the articulation pin and pivot pin of the balance wheel.

For this purpose, in a straightforward embodiment, the actuating arm is of approximately U-shaped design and has its two legs of the U extending away approximately from the region of the pin and can be driven in a pivotable manner by an actuating element which engages in the opening of the U, the leg of the U which is at the front as seen in the pivoting direction from the normal position into the blocking position being of resilient design in the pivoting direction.

It is possible for the pivot lever to be driven in a pivotable manner by a setting stem of the setting device, it being possible for said setting stem to be displaced axially between a normal position and a setting position. It is thus possible for the balance wheel to be arrested at the same time as the setting stem is moved into its setting position, for the purpose of adjusting the hands.

It is preferable here for the pivot lever to be driven in a pivotable manner by the setting stem, via a double-armed pivoting element which can be pivoted about a pivot pin.

For the purpose of setting a minute hand, it is possible for the setting step to be actuated in a rotatable manner.

Furthermore, the setting stem, in its normal position, may be used simultaneously as a winding stem.

BRIEF DESCRIPTION OF THE DRAWINGS

An exemplary embodiment of the invention is described in more detail hereinbelow and is illustrated in the drawing, in which.

DETAILED DESCRIPTION OF THE PREFERRED EMBODIMENTS

Figure 1:
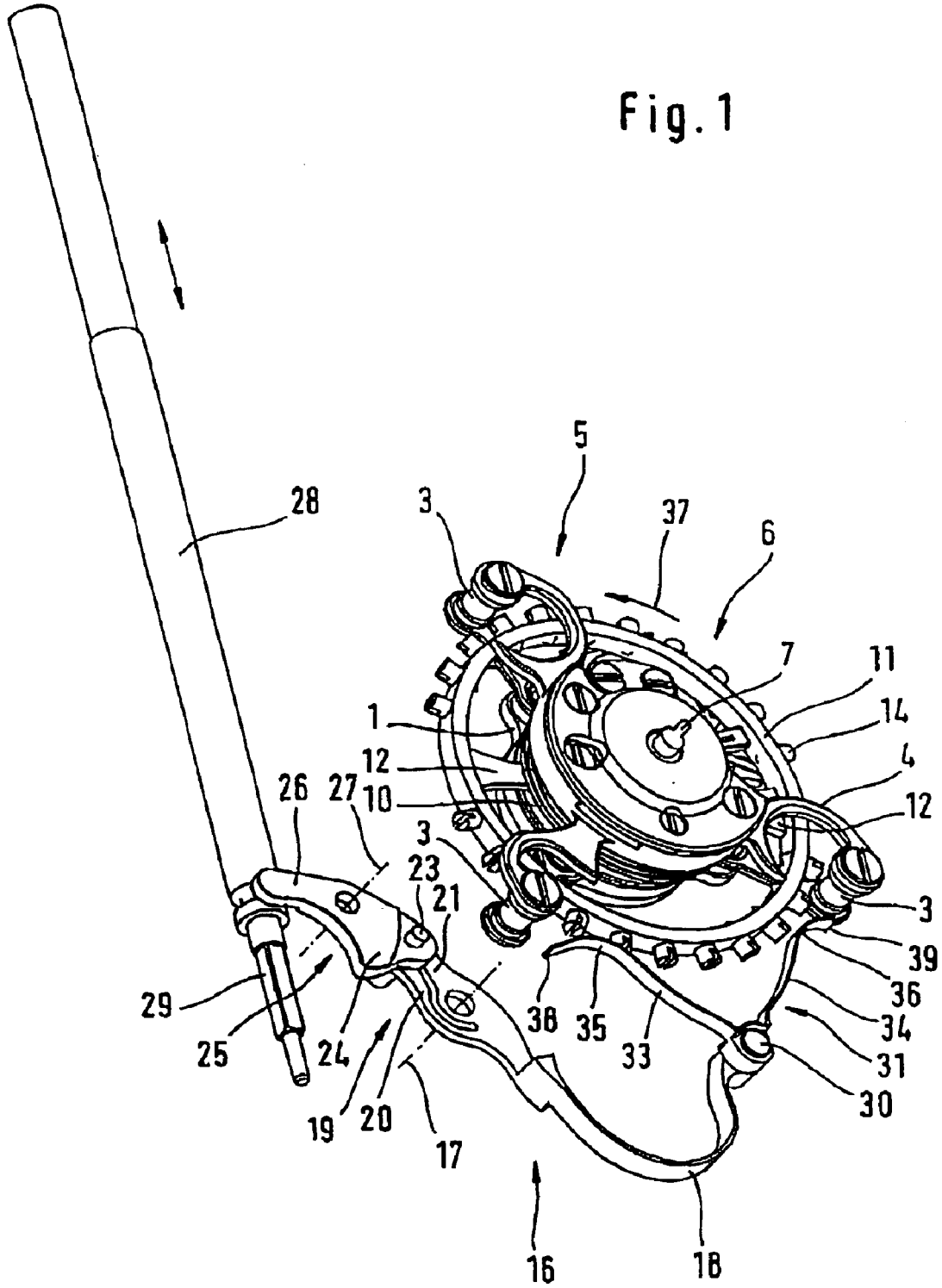
FIG. 1 is a perspective view of a tourbillon.
Figure 2:
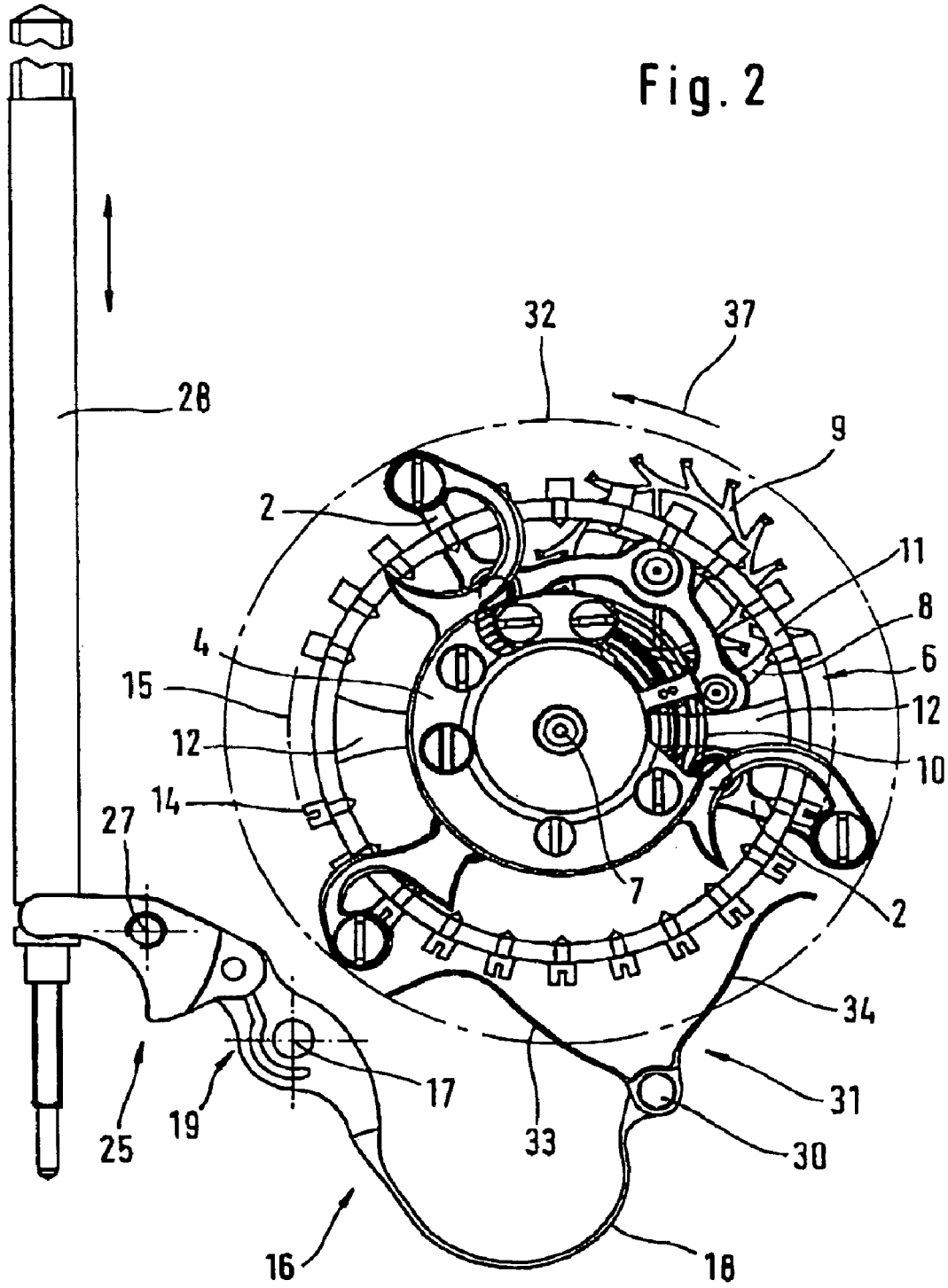
FIG. 2 is a plan view of the tourbillon according to FIG. 1.

The tourbillon illustrated in the figures has a base plate 1 with three radially outwardly directed arms 2, pillars 3 being arranged vertically at the free ends of said arms 2 and being connected to one another at their top end by a bridge 4, to form a basket-like cage 5. In the center of the cage 5, a circular balance wheel 6 is arranged on a balance staff. One end of the balance staff is mounted on the base plate 1 and the other end is mounted on the bridge 4, with the result that the balance wheel 6 can be pivoted about a pivot pin 7. The balance staff is enclosed by a balance spring 10.

Figure 3:
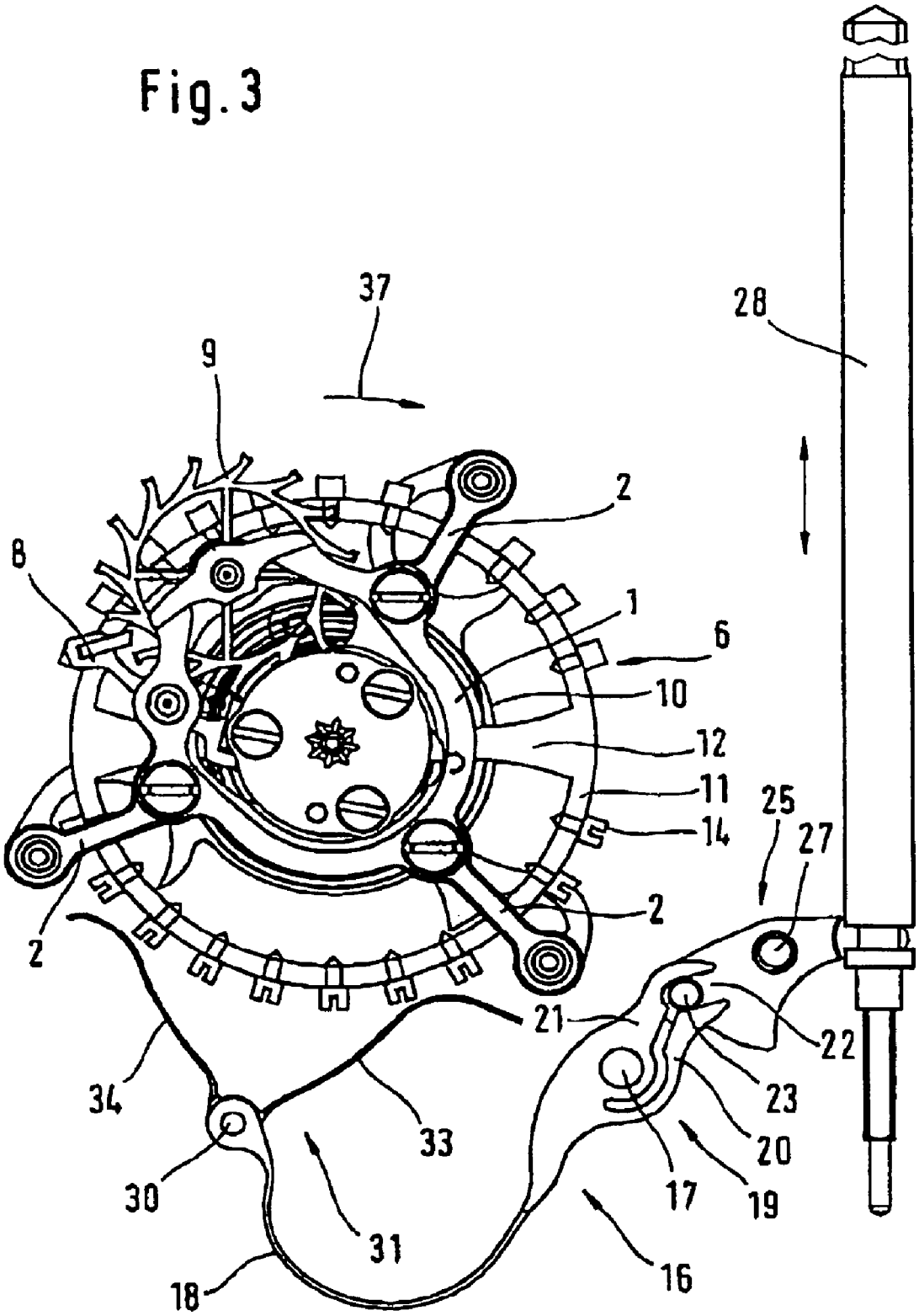
FIG. 3 shows a rear view of the tourbillon according to FIG. 1.

The balance wheel has a balance rim 11 which is connected, via balance legs 12, to the hub 13 of the balance wheel 6 (see FIG. 3), this, in turn, being arranged on the balance staff. The balance rim 11 has balance screws 14, which project radially outwards from the balance rim 11 by way of their screw heads.

Also arranged on the base plate 1 is an escapement comprising a pallet 8 and an escape wheel 9, the pallet 8 interacting with the balance wheel.

The pillars 3 are arranged radially outside the radially circulating contour 15 of the balance rim 11 and balance screws 14, with the result that the cage 5 encloses the balance wheel 6 in a basket-like manner.

The rotary mount, which is formed from the base plate 1 and cage, can be driven in a rotatable manner, at one revolution per minute, coaxially with the pivot pin 7 of the balance wheel 6.

Radially outside the balance wheel 6 and cage 5, a pivot lever 16 is mounted such that it can be pivoted about a pin 17 parallel to the swivel pin 7. The pivot lever 16 is a two-armed lever, of which one lever arm is an abutment lever 18, which is resiliently approximately in the radial direction in relation to the balance wheel 6, and the other lever arm is an actuating arm 19. The actuating arm 19 is of approximately U-shaped design, the two legs 20 and 21 of the U extending away approximately from the region of the pin 17. Engaging in the opening 22 of the U is a lever pin 23, which is arranged at the end of one lever arm 24 of a two-armed pivoting element 25. Acting at the end of the other lever arm 26 of the pivoting element 25, which can be pivoted about a pivot pin 27, is a manually actuable setting stem 28 of a setting device, which can be displaced out of a normal position into a setting position and, by virtue of being displaced, can cause the pivoting element 25 and thus also the pivot lever 16 to pivot.

The setting stem 28 serves, in its normal position, as a winding stem for the timepiece. By displacement out of the normal position, in the direction away from its end provided with a square stub 29, into the setting position illustrated, the lever pin 23 of the pivoting element 25, which is pivoted by the setting stem 28, acts on the leg 20 of the actuating arm 19 of the pivoting lever 16, said leg being of resilient design in its pivoting direction. The abutment lever 18 of the pivot lever 16 thus pivots, by way of its free end, in the direction of the balance wheel 6. At the free end of the abutment lever 18, a double-arm spring 31 is articulated such that it can be pivoted freely about an articulation pin 30 which is parallel to the pivot pin 7, said spring being pivoted out of its normal position, outside the circulating movement path 32 of the pillars, 12 into its blocking position by the abutment lever 18. In the blocking position illustrated, at least one of the two spring arms 33 and 34 comes into abutment against the radially circulating contour of the balance wheel 6, by way of its abutment region 35 and 36 of its free end regions, and blocks the pivoting movement of said balance wheel.

The spring arm 33 of the V-shaped double-arm spring 31 extends counter to, and the spring arm 34 extends in, the direction of rotation 37 of the cage 5. The double arm spring 31 is articulated on the abutment lever 18 at the point of connection of the two spring arms 33 and 34.

The distance between the articulation pin 30 and the abutment region 35 of the spring arm 34 is larger than the distance between the articulation pin 30 and the abutment point 36 of the spring arm 33.

Figure 5:
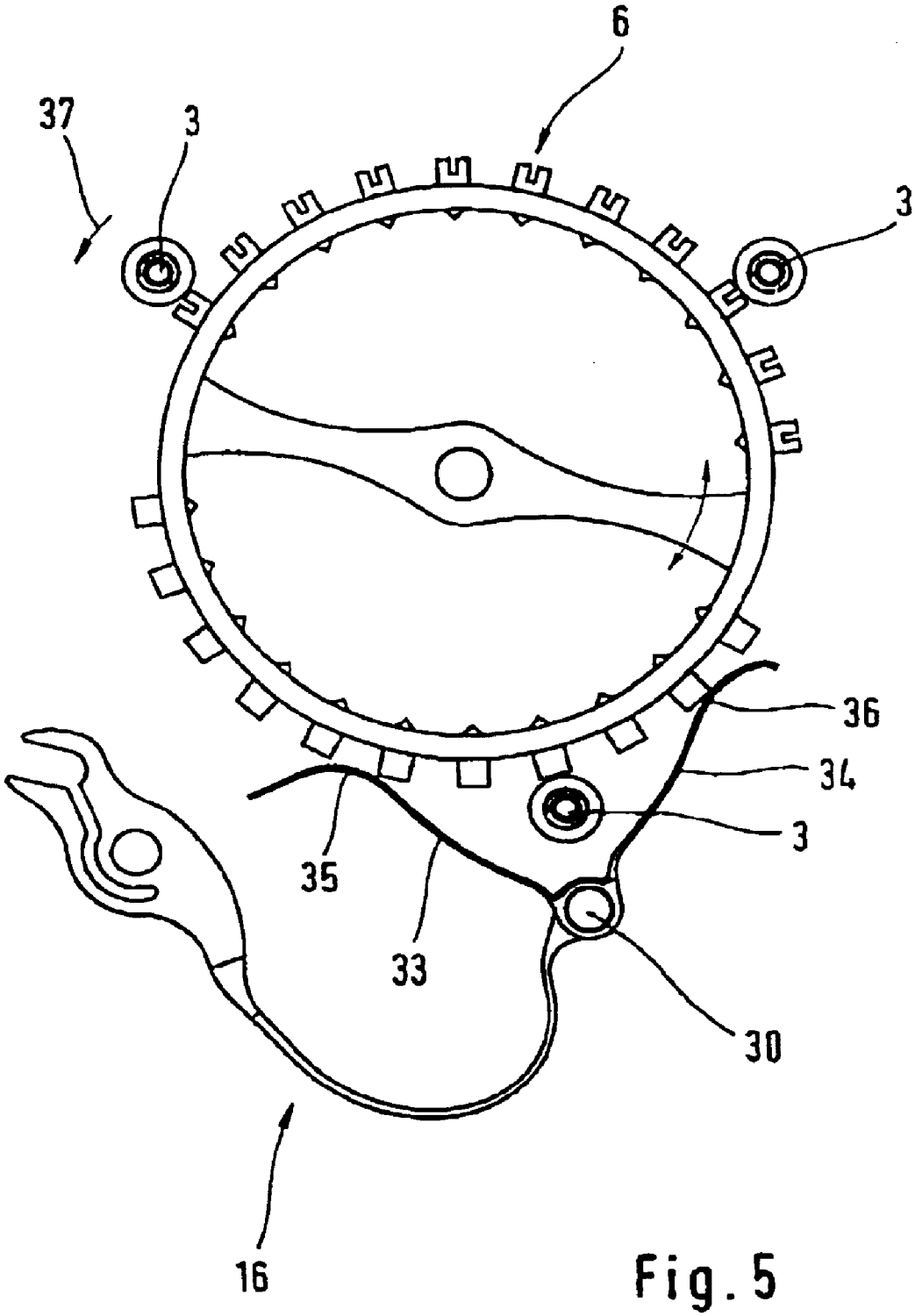
FIG. 5 is a plan view of the balance wheel, pivot lever and double-arm spring of the tourbillon according to FIG. 2 in a second blocking position.

It is also the case that the articulation pin 30 remains outside the circulating movement path 32 in the blocking position, with the result that the double-arm spring 31 can engage over a pillar 3 (FIG. 5).

The free ends 38 and 39 of the spring arms 33 and 34 extend away from the balance wheel 6 in a ramp-like manner from their abutment regions 35 and 36, the free end 38 of the rear spring arm 33, as seen in the direction of rotation 37, extending, in the blocking position, to a point radially outside the circulating movement path 32 of the pillars 3.

The free ends 38 and 39 of the spring arms 33 and 34 are spaced apart from one another by a distance which is smaller than the distance between two pillars 3.

FIGS. 4 to 7 illustrate the various possibilities for the spring arm 31 in its blocking position.

Figure 4:
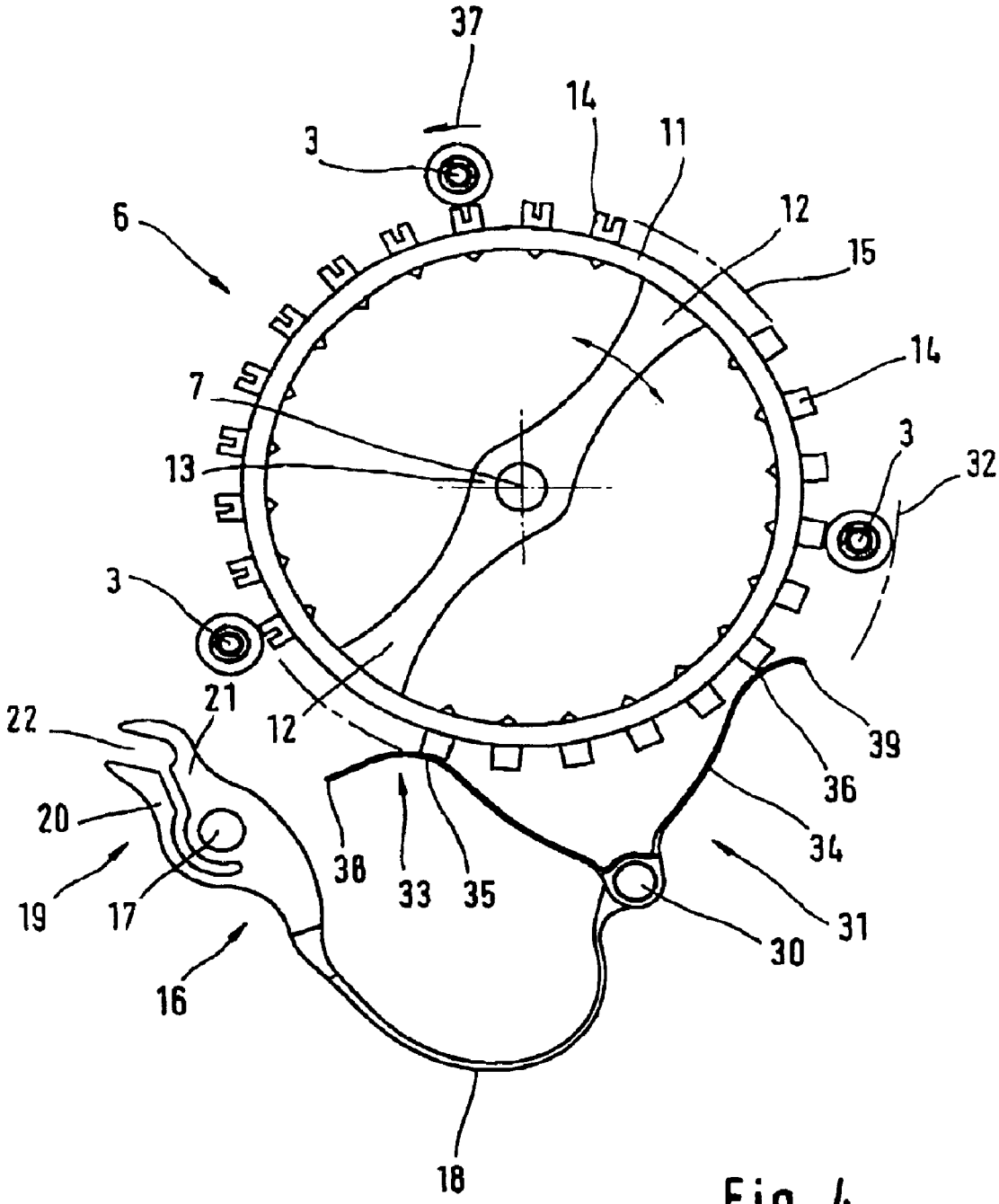
FIG. 4 is a plan view of the balance wheel, pivot lever and double-spring arm of the tourbillon according to FIG. 2 in a first blocking position.

FIG. 4 shows the double-arm spring 31 with its two spring arms 33 and 34 butting against the balance wheel 6 between two pillars 3.

In FIG. 5, the double-arm spring 31 engages over a pillar 3 and has a spring arm 33 and 34 butting against the balance wheel 6 on each side of the pillar 3.

Figure 6:
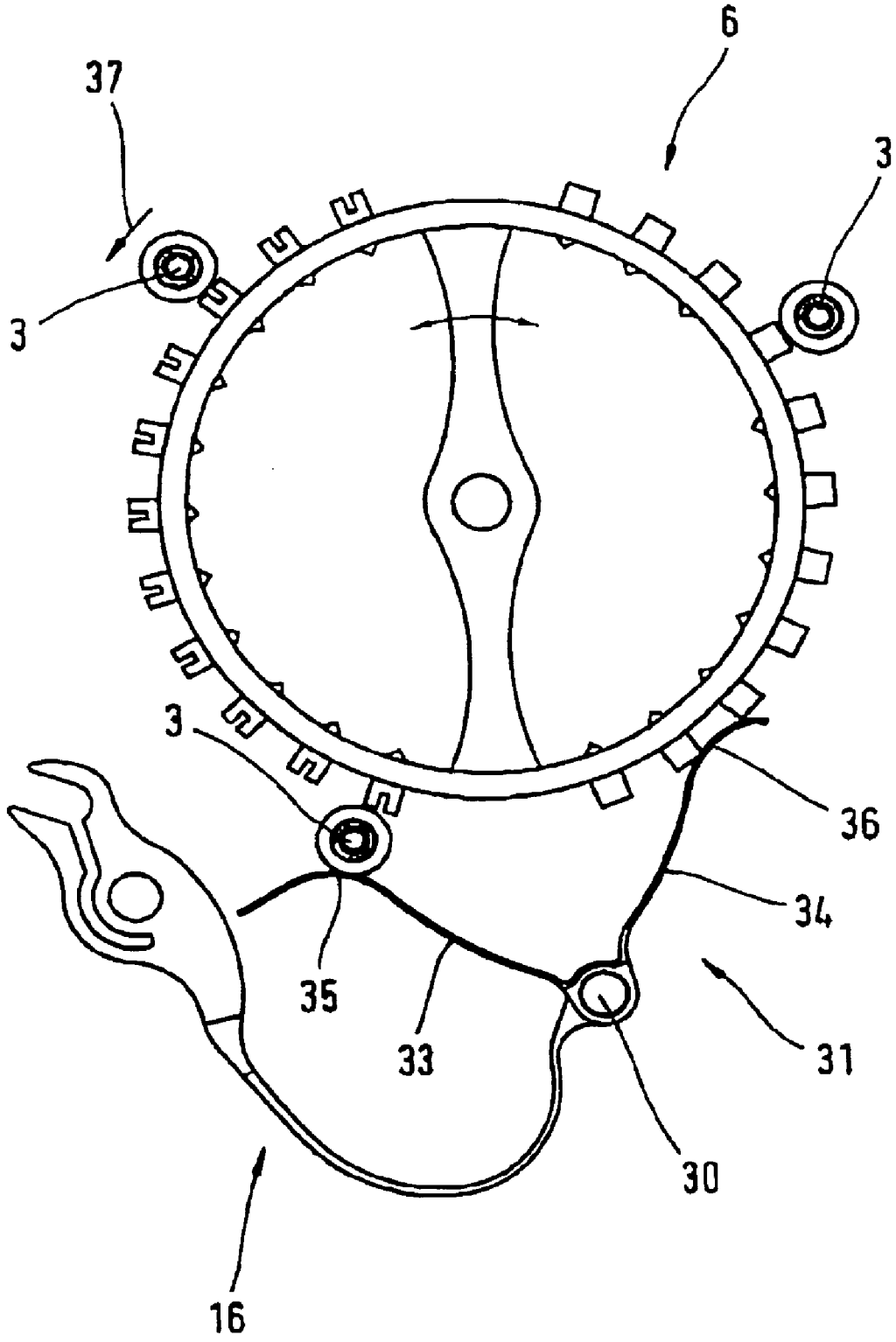
FIG. 6 is a plan view of the balance wheel, pivot lever and double-arm spring of the tourbillon according to FIG. 2 in a third blocking position.
Figure 7:
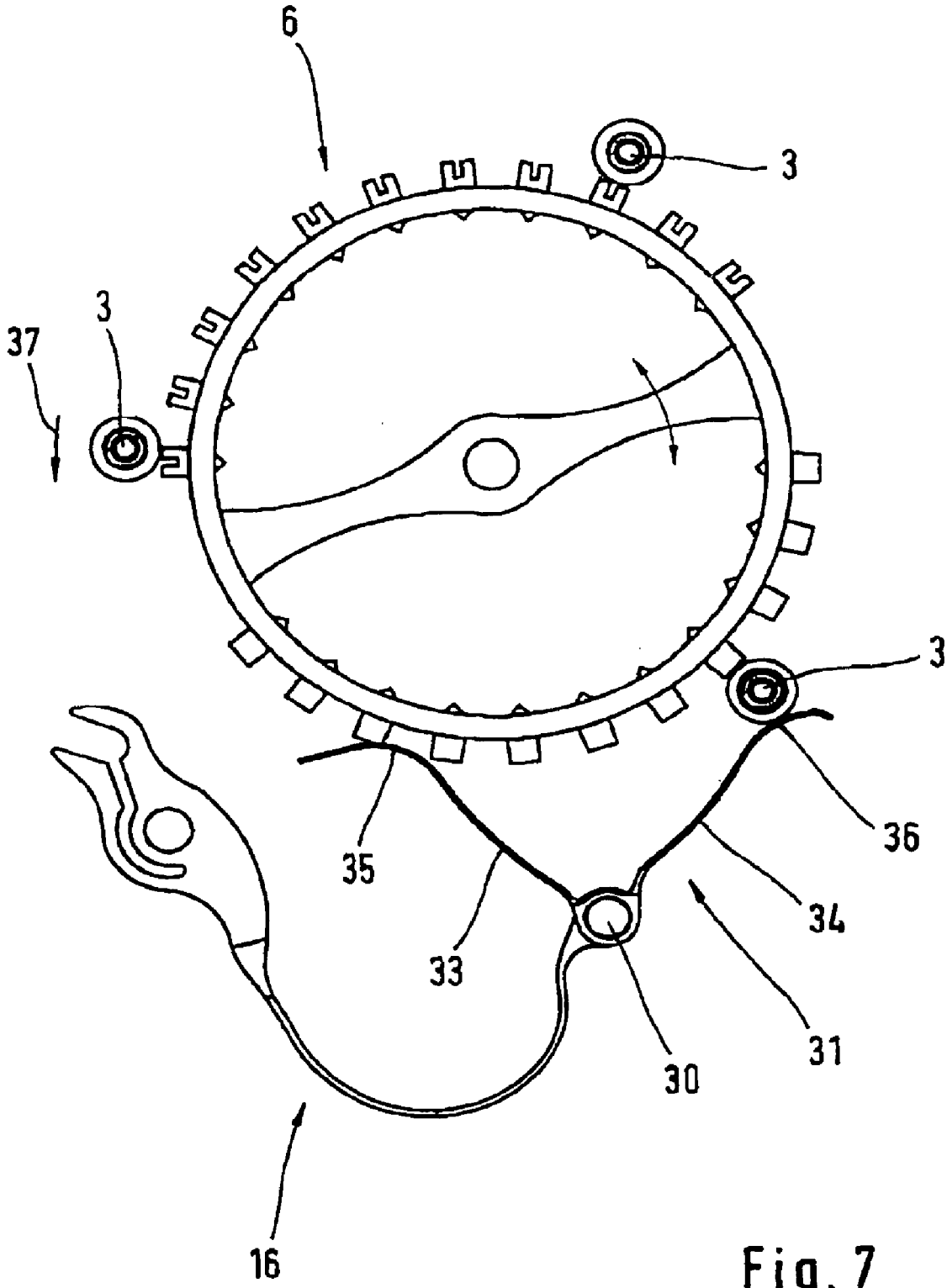
FIG. 7 is a plan view of the balance wheel, pivot lever and double-arm spring of the tourbillon according to FIG. 2 in a fourth blocking position.

In FIG. 6, the spring arm 33 bears against a pillar 3 and only the spring arm 34 butts against the balance wheel 6, while in FIG. 7 the spring arm 34 bears against a pillar 3 and the spring arm 33 butts against the balance wheel.

As these FIGS. 4 to 7 show, the balance wheel 6 is always blocked in the blocking position of the double-arm spring 31, irrespective of the position of the cage 5.

If the hands have been set by the setting stem 28, the setting stem is displaced manually in the downward direction, as seen in relation to the drawing, as a result of which the lever pin 23 acts on the flexurally rigid leg 21 of the actuating arm 19 and thus moves the pivot lever 16, with its abutment lever 18 and the double-arm spring 31, outside the movement path 32 of the pillars 3.

What is claimed is:

1. A tourbillon for a timepiece, comprising:

a rotary mount comprising a base plate and a cage connected to said base plate by a plurality of circumferentially distributed pillars, said rotary mount being connectable to a second hand drive of the timepiece for rotation about a rotary axis in a circulating direction;

a circular balance wheel pivotable about a pivot pin having one end mounted in said base plate and another end mounted in said cage, wherein said pivot pin is coaxial with said rotary axis of said rotary mount and said pillars of said cage are arranged outside a radially circulating periphery of said balance wheel;

an escapement including a pallet and an escape wheel operatively connected to said balance wheel and arranged on said base plate such that said balance wheel and said escapement are enclosed by said base plate and said cage;

a setting device for setting the hands of the time piece; and a stop device connected to said setting device and having a double-arm spring movable from a normal position, in which said double-arm spring is arranged radially outside a circulating movement path of said pillars, to a blocking position, in which said double-arm spring comprising one of a V-shaped and U-shaped spring having two spring arms with abutment regions proximate respective free ends of said two spring arms, wherein one of said two spring arms is directed counter to the circulating direction of said rotary mount and the other of said two spring arms is directed in the circulating direction of said rotary mount.

2. The tourbillon of claim 1, wherein said free ends of said spring arms are spaced apart from one another in a circumferential direction relative to said balance wheel by a distance which is smaller than the smallest distance between adjacent ones of said pillars.

3. The tourbillon of claim 1, wherein a point of connection between said two spring arms of said double-arm spring is radially outside the circulating movement path of said pillars when said double arm spring is located in the blocking position.

4. The tourbillon of claim 1, wherein portion of said spring arms between said free ends and said abutment regions of said spring arms extend away from a circumference of said balance wheel.

5. The tourbillon of claim 4, wherein said free end of a rear spring arm of said two spring arms relative to the circulating direction of said rotary mount, extends to a position radially outside the circulating movement path of said pillars when said double arm spring is located in the blocking position.

6. The tourbillon of claim 5, the distances between the point of connection and said abutment regions of said two spring arms are different.

7. The tourbillon as claimed in claim 6, wherein the distance between the point of connection and said abutment region of a front spring arm of the two spring arms relative to the circulating direction of said rotary mount is larger than the distance between the point of connection and said abutment region of a rear spring arm of the two spring arms relative to the circulating direction of said rotary mount.

8. The tourbillon of claim 1, the distances between a point of connection of said spring arms and said abutment regions of said two spring arms are different.

9. The tourbillon as claimed in claim 8, wherein the distance between the point of connection and said abutment region of a front spring arm of the two spring arms relative to the circulating direction of said rotary mount is larger than the distance between the point of connection and said abutment region of a rear spring arm of the two spring arms relative to the circulating direction of said rotary mount.

10. The tourbillon of claim 1, further comprising a pivot lever, wherein said two spring arms of said double-arm spring are connected at a point of connection articulated on said pivot lever such that said double-arm spring is freely pivotable about an articulation pin parallel to said pivot pin of said rotary mount, said pivot lever being pivotably actuatable about a pin likewise parallel to said pivot pin for moving said double-arm spring between the normal position and the blocking position.

11. The tourbillon as claimed in claim 10, wherein said pivot lever includes an abutment lever portion, a region of said abutment lever portion between said pin and said articulation pin being resilient approximately in the radial direction relative to said balance wheel.

12. The tourbillon of claim 10, wherein said pivot lever is a two-armed lever having a first arm comprising an abutment lever extending between said pin and said articulation pin and a second arm comprising an actuating arm which extends away from said pin and is subjected to pivoting action.

13. The tourbillon of claim 12, wherein said actuating arm is resilient in the pivoting direction of said pivot lever from the normal position into the blocking position.

14. The tourbillon of claim 12, wherein said actuating arm is approximately U-shaped with two legs of the U-shape extending away from said pin, said tourbillon further comprising an actuating element connected to said actuating arm for pivotably driving said actuating arm, said actuating element engaging an opening of the U-shape of said actuating arm, wherein one of said two legs which is at a front relative to the pivoting direction from the normal position into the blocking position is resilient in the pivoting direction.

15. The tourbillon of claim 10, wherein said pivot lever is pivotably drivable by a setting stem of said setting device, said setting stem being axially displaceable between a normal position and a setting position.

16. The tourbillon of claim 15, further comprising a double-armed pivoting element pivotal about a pivot pin, said pivot lever being pivotably drivable by said setting stem via said double-armed pivoting element.

17. The tourbillon of claim 15, wherein said setting stem is rotatably actuatable for setting a minute hand.

* * * * *